US009282830B2

(12) United States Patent
Jones

(10) Patent No.: US 9,282,830 B2
(45) Date of Patent: Mar. 15, 2016

(54) BEVERAGE CONTAINER HOLDER STORAGE UNIT

(71) Applicant: Trimm Jones, Channelview, TX (US)

(72) Inventor: Trimm Jones, Channelview, TX (US)

( * ) Notice: Subject to any disclaimer, the term of this patent is extended or adjusted under 35 U.S.C. 154(b) by 0 days.

(21) Appl. No.: 14/450,685

(22) Filed: Aug. 4, 2014

(65) Prior Publication Data

US 2015/0208825 A1 Jul. 30, 2015

Related U.S. Application Data

(63) Continuation of application No. 14/243,492, filed on Apr. 2, 2014, now abandoned, which is a continuation of application No. 14/168,502, filed on Jan. 30, 2014, now abandoned.

(51) Int. Cl.
*A47F 1/08* (2006.01)

(52) U.S. Cl.
CPC ..... *A47F 1/08* (2013.01)

(58) Field of Classification Search
CPC ..... A47F 1/065; A47F 1/085; A47F 1/106; A47F 1/123; A47F 1/125; A47F 1/08; A47F 1/12; B65D 81/3876; B65D 81/3879
USPC ..... 211/59.2, 59.3
See application file for complete search history.

(56) References Cited

U.S. PATENT DOCUMENTS

| | | | | | |
|---|---|---|---|---|---|
| 815,337 | A | | 3/1906 | Ellis | |
| 1,901,243 | A | * | 3/1933 | Horwitt | 221/279 |
| 2,226,626 | A | * | 12/1940 | Mann | 221/124 |
| 2,340,561 | A | | 2/1944 | Randolph | |
| 2,805,111 | A | | 9/1957 | Jarnot | |
| 3,248,156 | A | * | 4/1966 | Repko | 312/71 |
| 3,450,308 | A | | 6/1969 | Schoenefeld | |
| 4,170,325 | A | | 10/1979 | Pawlowski et al. | |
| 4,298,139 | A | * | 11/1981 | Radek | 221/198 |

(Continued)

FOREIGN PATENT DOCUMENTS

WO WO2013/023304 2/2013

OTHER PUBLICATIONS

Webstaurant.com, "The WEBstaurant store", published May 14th, 2013 and retrieved via the Internet Archive, <http://www.webstaurantstore.com/cal-mil-2050-classic-hot-cup-sleeve-dispenser-5-3-4-x-12-x-3-3-4/2112050.html>.*

(Continued)

*Primary Examiner* — Joshua Rodden
(74) *Attorney, Agent, or Firm* — Dunlap Codding, P.C.

(57) ABSTRACT

A beverage container holder storage unit is described as having a housing having a first end and a second end, a support member extending across the first end of the housing, and a force delivering element. The housing defines an interior cavity to receive a plurality of beverage container holders. The housing has a discharge slot along a portion of the first end for removing the beverage container holders. The support member has a recess formed along one side and is configured to receive a bottom tab of the beverage container holders. The recess is aligned with the discharge slot, such that when a user positions the tab of a bottommost beverage container holder within the recess, the beverage container holder is removable through the discharge slot. The force delivering element is positionable within the interior cavity and is configured to deliver force to collapse the bottommost beverage container holder.

6 Claims, 4 Drawing Sheets

(56) References Cited

U.S. PATENT DOCUMENTS

| | | | | |
|---|---|---|---|---|
| 4,329,001 | A * | 5/1982 | Filipowicz et al. | 312/71 |
| 4,491,242 | A * | 1/1985 | Trinidad | 221/312 R |
| 4,540,611 | A * | 9/1985 | Henderson | 428/12 |
| D282,234 | S * | 1/1986 | Henderson | D7/608 |
| 4,643,334 | A | 2/1987 | Steele | |
| 4,680,185 | A | 7/1987 | Illk | |
| 4,729,481 | A | 3/1988 | Hawkinson et al. | |
| 5,076,466 | A * | 12/1991 | Petterson et al. | 221/46 |
| 5,102,007 | A * | 4/1992 | Petterson et al. | 221/6 |
| 5,335,822 | A | 8/1994 | Kasper | |
| 5,445,315 | A * | 8/1995 | Shelby | 229/117.06 |
| 5,632,409 | A | 5/1997 | Raghunanan | |
| 5,713,488 | A | 2/1998 | Farrugia | |
| 5,957,325 | A * | 9/1999 | Montanez | 221/131 |
| 6,059,140 | A * | 5/2000 | Hicks | 220/739 |
| 6,230,931 | B1 | 5/2001 | Mandle et al. | |
| D451,349 | S * | 12/2001 | Tramontina et al. | D7/631 |
| 6,352,172 | B1 | 3/2002 | Chan et al. | |
| 6,419,113 | B1 * | 7/2002 | Tramontina | 221/45 |
| 6,799,695 | B1 | 10/2004 | Borrero | |
| 7,264,134 | B2 | 9/2007 | Tulp | |
| 7,341,166 | B2 | 3/2008 | Reinsel et al. | |
| D590,212 | S * | 4/2009 | Mancha et al. | D7/624.2 |
| 7,766,187 | B2 | 8/2010 | Schaefers | |
| 8,600,547 | B2 | 12/2013 | Petersen et al. | |
| 2006/0118568 | A1 * | 6/2006 | Hochtritt et al. | 221/45 |
| 2007/0034639 | A1 | 2/2007 | Zeiron | |
| 2010/0114366 | A1 | 5/2010 | Case et al. | |
| 2011/0024442 | A1 | 2/2011 | Schaefers | |
| 2012/0228322 | A1 | 9/2012 | Comerford | |
| 2013/0221019 | A1 | 8/2013 | Rozek | |
| 2013/0228587 | A1 | 9/2013 | Formon | |
| 2013/0289765 | A1 | 10/2013 | Saffran | |

OTHER PUBLICATIONS www.mrtakeoutbags.com, "MrTakeOutBags", published on Apr. 29, 2012 and accessed via the Internet archive, <www.mrtakeoutbags.com>.*

* cited by examiner

BEVERAGE CONTAINER HOLDER STORAGE UNIT

This application is a continuation of U.S. Ser. No. 14/243,492, filed on Apr. 2, 2014, which is a continuation of U.S. Ser. No. 14/168,502, filed on Jan. 30, 2014, the entire contents of which are hereby expressly incorporated herein by reference.

BACKGROUND

Collapsible beverage container holders are made available to users as promotional materials, from vendors, at dining and drinking establishments, and other venues. After being removed from a manufacturer's packaging and after use, collapsible beverage container holders often naturally expand and present difficulties for storing them in an orderly fashion. Currently, many end users, including eating and drinking establishments, store collapsible beverage container holders loosely on shelves, in drawers, in boxes or in baskets. Even when bundled together with elastic, tied, or twistable bundling devices, these stored collapsible beverage container holders are often disorderly, and are not readily available to dispense to a user.

Napkin holders of varying types are well known in the art, such as the napkin holder disclosed in U.S. Pat. No. 4,491,242 to Trinidad and the sanitary napkin holder disclosed in U.S. Pat. No. 6,799,695 to Borrero. These napkin and sanitary napkin holders often store napkins or sanitary napkins in a stacked configuration for dispensing to users. However, the dimensions of and the delivery mechanisms of current napkin holders are often wholly unsuitable to storing and dispensing collapsible beverage container holders. For example, many napkin holders have an opening which will not accommodate the insertion of or the removal of a collapsible beverage container holder. Napkin holders often lack a sufficient force delivery mechanism to maintain a collapsed and orderly state of a stack of collapsible beverage container holders. Additionally other difficulties presented by current napkin holders prevent their use with collapsible beverage container holders.

Therefore, there is a need for a storage and dispensing unit capable of storing and dispensing a plurality of collapsible beverage container holders in an orderly manner.

SUMMARY

In some embodiments of the present disclosure, a storage unit for storing and dispensing a plurality of collapsible beverage container holders is disclosed. The collapsible beverage container holders have a sidewall and a bottom connected to the sidewall. The bottom forms a bottom tab when the sidewall is collapsed. The storage unit has a housing having a first end and a second end and a support member extending across the first end of the housing. The housing defines an interior cavity to receive the plurality of collapsible beverage container holders in a stacked formation. The housing has a discharge slot along a portion of the first end thereof for removing one of the plurality of collapsible beverage container holders from the interior cavity. The support member has a recess formed along at least one side thereof. The recess is configured to receive the bottom tab of one of the plurality of collapsible beverage container holders. The recess is aligned with the discharge slot, such that when a user positions the bottom tab of a bottommost collapsible beverage container holder, of the plurality of collapsible beverage container holders, within the recess, the bottommost collapsible beverage container holder is removable through the discharge slot.

In another version, a beverage container holder storage unit is described as having a housing with a first end and a second end, a support member extending across the first end of the housing, and a force delivering element positionable within the housing. The housing defines an interior cavity to receive a plurality of collapsible beverage container holders in a stacked formation. The housing has a discharge slot along a portion of the first end thereof for removing one of the plurality of collapsible beverage container holders from the interior cavity. The support member has a recess formed along at least one side thereof. The recess is configured to receive a bottom tab of one of the plurality of collapsible beverage container holders. The recess is aligned with the discharge slot, such that when a user positions the bottom tab of a bottommost collapsible beverage container holder, of the plurality of collapsible beverage container holders, within the recess, the bottommost collapsible beverage container holder is removable through the discharge slot. The force delivering element is positionable within the interior cavity of the housing and configured to deliver force sufficient to collapse the bottommost collapsible beverage container holder within the interior cavity.

In another version, a storage unit in combination with a plurality of collapsible beverage container holders is described. The collapsible beverage container holders each have a sidewall and a bottom connected to the sidewall. The bottom forms a bottom tab when the sidewall is collapsed. The storage unit has a housing having a first end and a second end and a support member extending across the first end of the housing. The housing defines an interior cavity having the plurality of collapsible beverage container holders in a stacked formation. The housing has a discharge slot along a portion of the first end thereof for removing one of the plurality of collapsible beverage container holders from the interior cavity. The support member has a recess formed along at least one side thereof. The recess is configured to receive the bottom tab of one of the plurality of collapsible beverage container holders. The recess is aligned with the discharge slot, such that a user positions the bottom tab of a bottommost collapsible beverage container holder, of the plurality of collapsible beverage container holders, within the recess to remove the bottommost collapsible beverage container holder through the discharge slot.

In some embodiments, a method for storing a beverage container holder is described as utilizing a beverage container holder storage unit configured to receive a plurality of collapsible beverage container holders in a stacked configuration. The beverage container holder storage unit includes a housing, a support member extending across a first end of the housing, and a force delivering element. A plurality of collapsible beverage container holders are inserted into the beverage container holder storage unit to form a stacked configuration. The method is further performed by inserting the force delivering element on top of the stacked configuration of the plurality of beverage container holders.

In another version, a method for dispensing a beverage container holder is presented and performed by utilizing a beverage container holder storage unit configured to receive a plurality of collapsible beverage container holders in a stacked configuration. The beverage container holder storage unit includes a housing, a support member extending across a first end of the housing, and a force delivering element. A plurality of collapsible beverage container holders are inserted into the beverage container holder storage unit to form the stacked configuration. The force delivering element is inserted on top of the stacked configuration of the plurality of beverage container holders. The method is further performed by dispensing a bottommost beverage container holder from the beverage container holder storage unit through a discharge slot in the beverage container holder storage unit.

BRIEF DESCRIPTION OF THE DRAWINGS

Certain embodiments of the inventive concepts will hereafter be described with reference to the accompanying drawings, wherein like reference numerals denote like elements. It should be understood, however, that the accompanying figures illustrate the various implementations described herein and are not meant to limit the scope of the various technologies described herein.

DETAILED DESCRIPTION

Specific embodiments of the inventive concepts disclosed herein will now be described in detail with reference to the accompanying drawings. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited or inherently present therein.

As used herein any references to "one embodiment," "an embodiment," or "some embodiments" means that a particular element, feature, structure, or characteristic described in connection with the embodiment is included in at least one embodiment. The appearances of the phrase "in one embodiment" in various places in the specification may not refer to the same embodiment.

The present disclosure is generally directed to a storage and dispensing device, more specifically, toward a beverage container holder storage and dispensing unit configured to store a plurality of collapsible beverage container holders in a stacked configuration. The beverage container holder storage and dispensing unit may enable dispensing of a bottommost collapsible beverage container holder at of the stack of the plurality of collapsible beverage container holders. The collapsible beverage container holders stacked in the beverage container holder storage unit may be collapsible beverage container holders and in some embodiments may be insulated collapsible beverage container holders.

Figure 1:
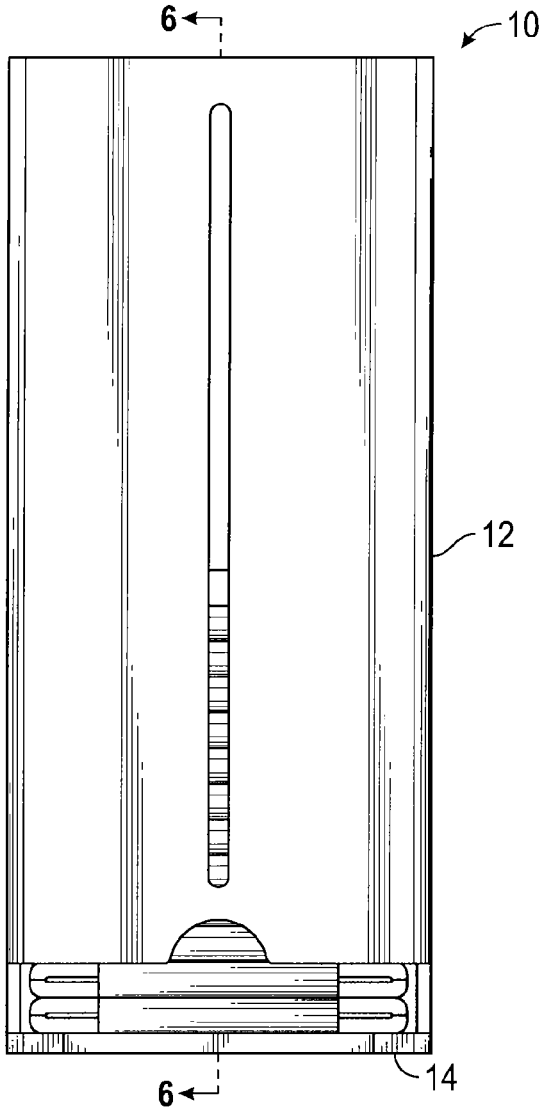
FIG. 1 is an elevational view of a beverage container holder storage unit in accordance with some embodiments of the present disclosure.
Figure 2:
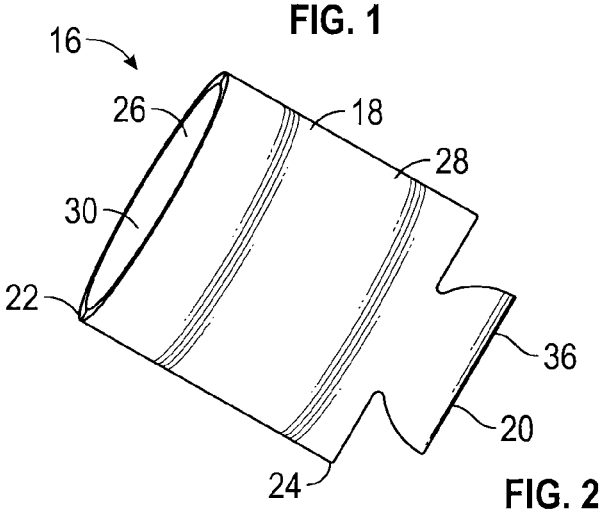
FIG. 2 is a perspective view of a beverage container holder in accordance with some embodiments of the present disclosure.

Referring now to FIGS. 1 and 2, shown therein is a beverage container holder storage unit 10 having a housing 12 and a support member 14 extending across an end of the housing 12 and a collapsible beverage container holder 16 to be positioned within the beverage container holder storage unit 10.

Figures 3, 4:
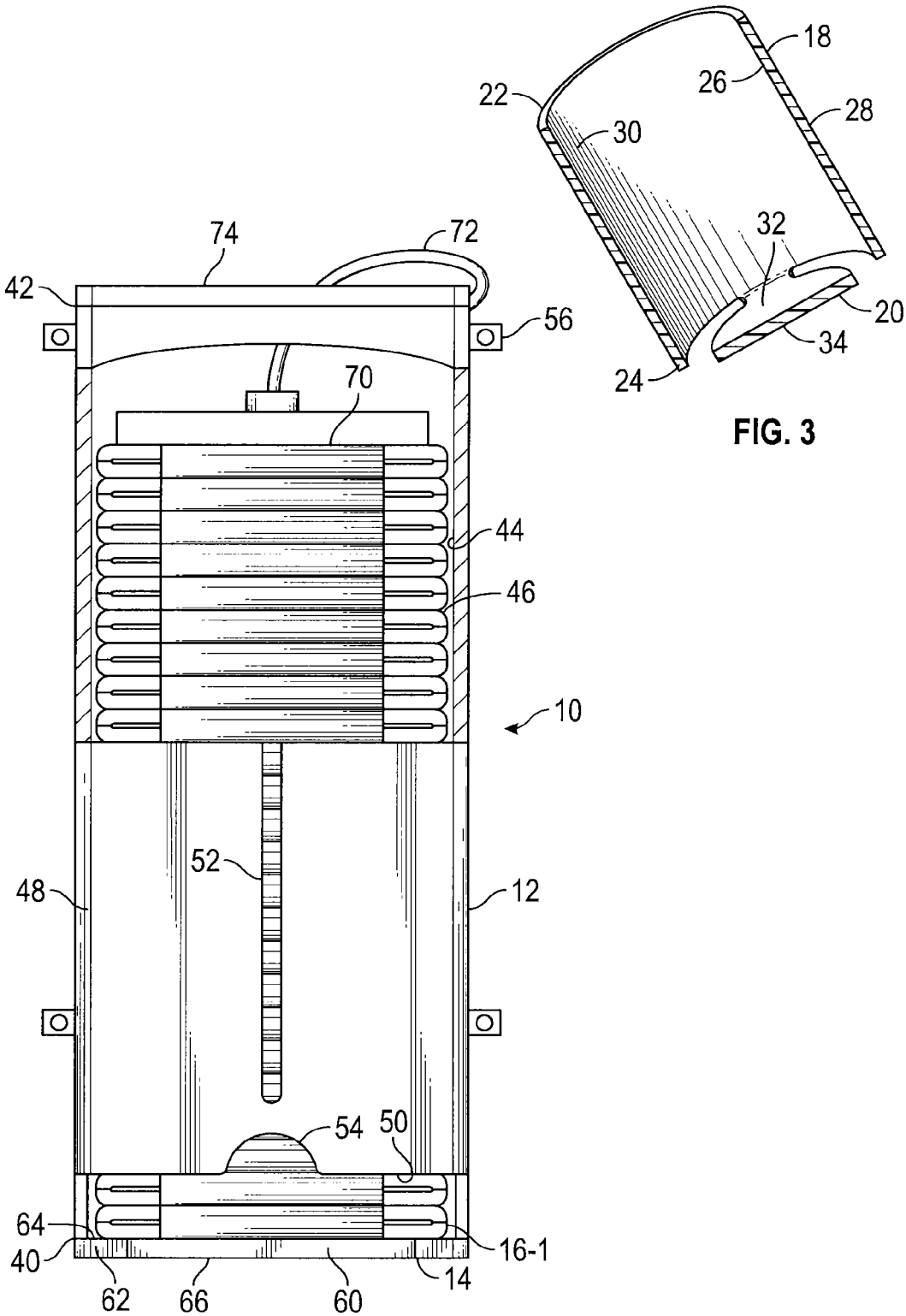
FIG. 3 is a cross sectional view of the beverage container holder of FIG. 2.
FIG. 4 is a partial cut-away view of the beverage container holder storage unit of FIG. 1.

Referring now to FIGS. 2 and 3, the collapsible beverage container holder 16 has one or more sidewall 18 and a bottom 20 connected to the one or more sidewall 18. Each of the one or more sidewall 18 has a first end 22, a second end 24 opposite the first end 22, a first surface 26, and a second surface 28. The first surface 26 of the one or more sidewall 18 defines a cavity 30, having a substantially circular shape. The bottom 20 may have a first surface 32 and a second surface 34 opposite the first surface 32. In some embodiments, the beverage container holder 16 may be collapsible, such that when collapsed, in some embodiments, the cavity 30 is compressed from a substantially circular shape to a substantially elliptical shape. In some embodiments, when collapsed, at least a first portion of the first surface 26 of the one or more sidewall 18 may be positioned to be in contact with at least a second portion of the first surface of the one or more sidewall 18. In either event, the bottom 20 creates a bottom tab 36 by folding the bottom 20 such that a first portion of the first surface 32 of the bottom 20 is positioned proximate to or contacting a second portion of the first surface 32 of the bottom 20. Once formed, the bottom tab 36 extends outwardly from the second end 24 of the one or more sidewall 18.

The collapsible beverage container holder 16 may be formed from foam, plastics, composite materials, textile materials, cardboard, corrugated cardboard, or any other suitable material, such that the collapsible beverage container holder 16 may be flattened and/or folded into a substantially collapsed form and be expanded to contain a beverage container, such as a bottle, can, or cup, for use to insulate a user's hand from the temperature of the contents of the beverage container or to assist in gripping the beverage container.

Figure 5:
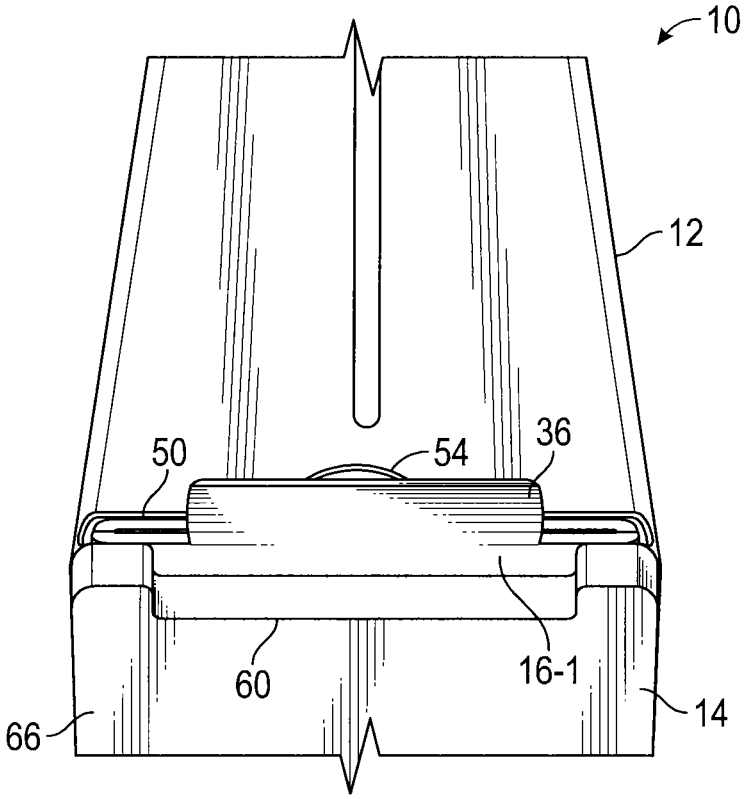
FIG. 5 is a perspective view of the beverage container holder storage unit of FIG. 1.

Referring now to FIGS. 1, 4, and 5, in some embodiments, the housing 12 and the support member 14 of the beverage container holder storage unit 10, as will be explained in more detail below, may be formed integrally via injection molding, 3D printing, milling, selective metal sintering, or other suitable integral construction method. In some embodiments, where the housing 12 and the support member 14 are formed as separate elements, the beverage container holder storage unit 10 may be formed from welding, brazing, adhesives, mechanical connections, joinery, combinations thereof, or other suitable connection mechanisms.

The housing 12 of the beverage container holder storage unit 10 may include a first end 40 and a second end 42 opposite the first end 40. The housing 12 may define an interior cavity 44 within the housing 12 to receive a plurality of the collapsible beverage container holders 16 in a stacked formation 46. The interior cavity 44 may be configured and/or sized and dimensioned to receive and store the plurality of collapsible beverage container holders 16. In some embodiments, the housing 12 may comprise a substantially circular cross section, a substantially elliptical cross section, or other cross sections capable of being formed from a single sidewall 48. In some of these embodiments, the internal cavity 44 may have either a corresponding circular or elliptical cross section. In some other of these embodiments the housing 12 may be of varying thickness of have a plurality of sidewalls 48, thereby enabling the internal cavity 44 to be in a polygonal shape, such as a substantially rectangular, square, octagonal, or other polygonal shape. In some embodiments, the housing 12 and interior cavity 44 may have a polygonal shape, such as a substantially rectangular, square, octagonal, or other polygonal shape, and may be sized and dimensioned to receive the collapsible beverage container holders 16. For example, in some embodiments, where the housing 12 has a substantially rectangular shape, the interior cavity 44 may be between about three and five inches in width and between about four and seven inches in length. In some embodiments, the plurality of collapsible beverage container holder 16 may be received by the interior cavity 44 in a stacked configuration through the second end of the housing.

The housing 12 may be formed from steel, stainless steel, plastics, composite materials, coated steels, coated plastics, wood, particle board, fibreboard, combinations thereof, or any other suitable material. As stated above, the housing 12 may be formed separate from or integral to the support member 14, and when formed separate from the support member 14 may be connected to the support member 14 with any of the above referenced or any other suitable connection mechanism. Additionally, the housing 12 may include any number of sidewalls 48 to create varying cross sectional shapes and/or configurations of the housing 12. For example, the housing 12 may have a first set of sidewalls 48 defining the interior cavity 44 and a second set of sidewalls 48 defining a cover for the housing 12 and displaying advertising or providing a protective enclosure for the housing 12.

The housing 12 may include a discharge slot 50 for removing one of the plurality of collapsible beverage container holders 16 from the interior cavity 44. The discharge slot 50 may be proximate to the first end 40 of the housing 12. The discharge slot 50 may extend from the first end 40 of the housing 12 toward the second end 42. The discharge slot 50 may be configured and/or sized and dimensioned to enable a bottommost collapsible beverage container holder 16 of the stack 46 of collapsible beverage container holders 16 within the interior cavity 44, to be removed through the discharge slot 50. For example, in some embodiments, the discharge slot 50 may be between about 0.2 inches and about one inch in height, and between about three and five inches in width. In some embodiments, the housing 12 may further define an inventory indicator 52.

The discharge slot 50 may have a generally rectangular shape. In some embodiments, the housing 12 may further define a notch 54 extending upwardly from the discharge slot 50. The notch 54 may be configured and/or sized and dimensioned to receive at least a portion of a finger or a thumb of a user. In some embodiments, the notch 54 may be a semicircular notch, a polygonal notch, a rectangular notch, or any other suitable shape.

The inventory indicator 52 may be formed as one or more opening defined by the housing 12. In some embodiments, the inventory indicator 52 may be an opening extending at least partially between the first and second ends 40 and 42 of the housing 12 and extending through the housing 12. In these embodiments, a user may view the stack 46 of the plurality of collapsible beverage container holders 16 stacked within the interior cavity 44 through the inventory indicator 52. In some embodiments, the inventory indicator 52 may be formed by a plurality of openings defined by the housing 12, with each of the plurality of openings spaced a distance apart between the first and second ends 40 and 42. In these embodiments, the user may determine a number of the plurality of collapsible beverage container holders 16 stacked within the interior cavity 44 by determining a relative level of the stack 46 of the plurality of collapsible beverage container holders 16 based on which of the plurality of openings is obscured by the stack 46.

In some embodiments, the inventory indicator 52 may work in combination with a level indicator (not shown) which may be positioned at the top of the stack 46 of the plurality of collapsible beverage container holders 16. The level indicator may be marked sufficient to be seen within the interior cavity 44 through the inventory indicator 52. In some embodiments, the level indicator may include a tab, which may be positioned in the inventory indicator 52 when the level indicator is placed on top of the stack 46 of the plurality of collapsible beverage container holders 16. In these embodiments, the tab may extend into the opening forming the inventory indicator 52 at least a portion of the distance of a thickness of the housing 12.

In some embodiments, the housing 12 may include one or more mounting members 56. The one or more mounting members 56 may be defined by, formed on, or connected to the housing 12 such that the beverage container holder storage unit 10 may be mounted to a wall. For example, the one or more mounting members 56 may be one or more openings defined by the housing 12 and may be sized and dimensioned to receive screws, bolts, nails, or other members capable of securing the beverage container holder storage unit 10 to a wall. In some embodiments, the one or more mounting members 56 may be formed on the housing 12 as an integral part of the housing 12. In these embodiments, the one or more mounting members 56 may include a tab extending outwardly from the housing 12 or the at least one sidewall 48. The tab may define one or more openings sized and dimensioned to receive screws, bolts, nails, or other members capable of securing the beverage container holder storage unit 10 to a wall. In some embodiments, the one or more mounting members 56 may be formed from tabs, as described above, but may be formed separately from the housing 12 or the at least one sidewall 48 and connected thereto via brazing, welding, adhesive, or a mechanical connection mechanism such as screws or nuts and bolts, combinations thereof, or other suitable connection mechanisms.

The support member 14 may extend across the first end 40 of the housing 12. The support member 14 may have a recess 60 formed along at least one side 62 thereof. The recess 60 may be configured and/or sized and shaped to receive the bottom tab 36 of one of the plurality of collapsible beverage container holders 16. In some embodiments, the recess 60 may be aligned with the discharge slot 50. In these embodiments, the recess 60 may be aligned such that when a user positions the bottom tab 36 of a bottommost collapsible beverage container holder 16-1, of the plurality of collapsible beverage container holders 16, within the recess 60, the bottommost collapsible beverage container holder 16-1 may be removable through the discharge slot 50.

For example, the user may position the bottom tab 36 of the bottommost collapsible beverage container holder 16-1 within the recess by depressing the bottom tab 36 with the user's thumb. The user may then grip the bottom tab 36 with one or more of the user's fingers and remove the bottommost collapsible beverage container holder 16-1 from the discharge slot 50 by pulling the bottommost collapsible beverage container holder 16-1 through the discharge slot 50 and away from the beverage container holder storage unit 10 in a horizontal plane extending outwardly from the discharge slot 50. In some embodiments, the user may pull the bottommost collapsible beverage container holder 16-1 through the discharge slot 50 and away from the beverage container holder storage unit 10 at an angle from the horizontal plane extending outwardly from the discharge slot 50.

The support member 14 may be formed from steel, stainless steel, plastics, composite materials, coated steels, coated plastics, metals, wood, particle board, fibreboard, combinations thereof, or any other suitable material. The support member 14 may be formed separate from or integral to the housing 12. In embodiments where the support member 14 is formed separate from the housing 12, the support member 14 may be connected to the housing 12 via brazing; welding; adhesives; mechanical connections such as nuts and bolts, screws, latches, or screw threads integral to the support member 14 and the housing 12; combinations thereof; or any other suitable mechanical, adhesive, or other connection mechanism. In embodiments where the support member 14 is formed integral to the housing 12, a junction between the support member 14 and the housing 12 may be bolstered or reinforced by one or more support members connected to both the housing 12 and the support member 14 via one of the above referenced connection mechanisms appropriate for the material used to form the support member 14 and the housing 12.

In some embodiments, as shown, the recess 60 may extend through the support member 14, while in other embodiments, the recess 60 may extend only partially through the support member 14 from a first surface 64 toward a second surface 66. In some embodiments, the recess 60 may be substantially rectangular in shape and be sized and dimensioned to receive the bottom tab 36 of the bottommost collapsible beverage container holder 16-1. In some embodiments, the recess 60 may have a substantially trapezoidal shape, or other polygonal shape.

In some embodiments, as shown in FIG. 4, the beverage container holder storage unit 10 may include a force delivering element 70 positionable within the interior cavity 60 of the housing 12. The force delivering element 70 may be configured to deliver force sufficient to collapse the bottommost collapsible beverage container holder 16-1 within the interior cavity 44. In some embodiments, the force delivering element 70 may be configured to deliver force sufficient to collapse the stack 46 of the plurality of the beverage container holders 16, positioned in the stacked configuration, within the interior cavity 44 of the housing 12. For example, the force delivering element 70 may be configured to collapse 100 or fewer of the collapsible beverage container holders 16 positioned within the interior cavity 44. By way of a further example, the force delivering element 70 may be configured to collapse any number of the collapsible beverage container holders 16 which may be positioned in the interior cavity 44, in the stacked configuration, between the first and second ends 40 and 42 of the housing 12.

The force delivering element 70 may be configured to be positioned on top of the stack 46 of the plurality of collapsible beverage container holders 16 within the interior cavity 44. In some embodiments, the force delivering element 70 may be configured to deliver consistent force to the plurality of collapsible beverage container holders 16 regardless of the vertical position of the force delivering element 70 within the interior cavity 44 between the first and second ends 40 and 42 of the housing 12. In some embodiments, a connector 72 may extend between the force delivering element 70 and the housing 12 to connect the force delivering element 70 proximate to the second end 42 of the housing 12, such that the force delivering element 70 maintains a connection to the housing 12 when removed from the interior cavity 44. In some embodiments, the force delivering element 70 may be included without the connector 72, and may be sized and dimensioned to be removed through the discharge slot 50 or through the second end 42 of the housing 12.

The force delivering element 70 may be implemented as a weight, sized and dimensioned to be positioned within the interior cavity 44 of the housing 12. In these embodiments, the force delivering element 70 may be formed from steel, stainless steel, lead, plastic, composite materials, aluminium, wood, rock, combinations thereof, or any other suitable material. In some embodiments, the force delivering element 70 may also be implemented as a ratchet device, for example, with teeth positioned on an interior of the housing 12 and at least one pawl extending from the force delivering element 70. In some embodiments, the force delivering element 70 may be implemented using one or more screw, one or more piston, one or more mounting rails, one or more automated feeding device, combinations thereof, or any other suitable mechanism or combination of mechanisms. In some embodiments, the force delivering element 70 may function as the level indicator, cooperating with the inventory indicator 52 to enable a user to determine the number of collapsible beverage container holders 16 within the interior cavity 44. For example, the force delivering element 70 may be provided with the tab extending into the inventory indicator 52 or may be painted a high contrast or high visibility color to enable viewing through the inventory indicator 52.

The connector 72 may be formed from wire, rope, string, plastic, composite material, coated wire, combinations thereof, or any other suitable material for connecting the force delivering element 70 and the housing 12 of the beverage container holder storage unit 10, such that the connector 72 may be used, at least in part, to retrieve the force delivering element 70 from the interior cavity 44.

In some embodiments, the beverage container holder storage unit 10 may include a lid 74, sized and dimensioned to cover at least a portion of the second end 42 of the housing 12. In some embodiments, the lid 74 may be positioned at least partially within interior cavity 44 proximate to the second end 42 of the housing 12. In some embodiments, the lid 74 may overlap at least a portion of an outer surface of the housing 12 and cover the second end 42 of the housing 12. In some embodiments, the lid 74 may define an opening, extending through the lid 74, such that the connector 72 may pass through the lid 74 while extending from a connecting position proximate to the second end 42 of the housing 12 to the force delivering element 70 positioned within the interior cavity 44. In some embodiments, the lid 74 may be provided with a mechanism to secure the lid 74 to the housing 12, such as screw threads, one or more latch, one or more hinge, or any other suitable mechanism.

Figure 6:
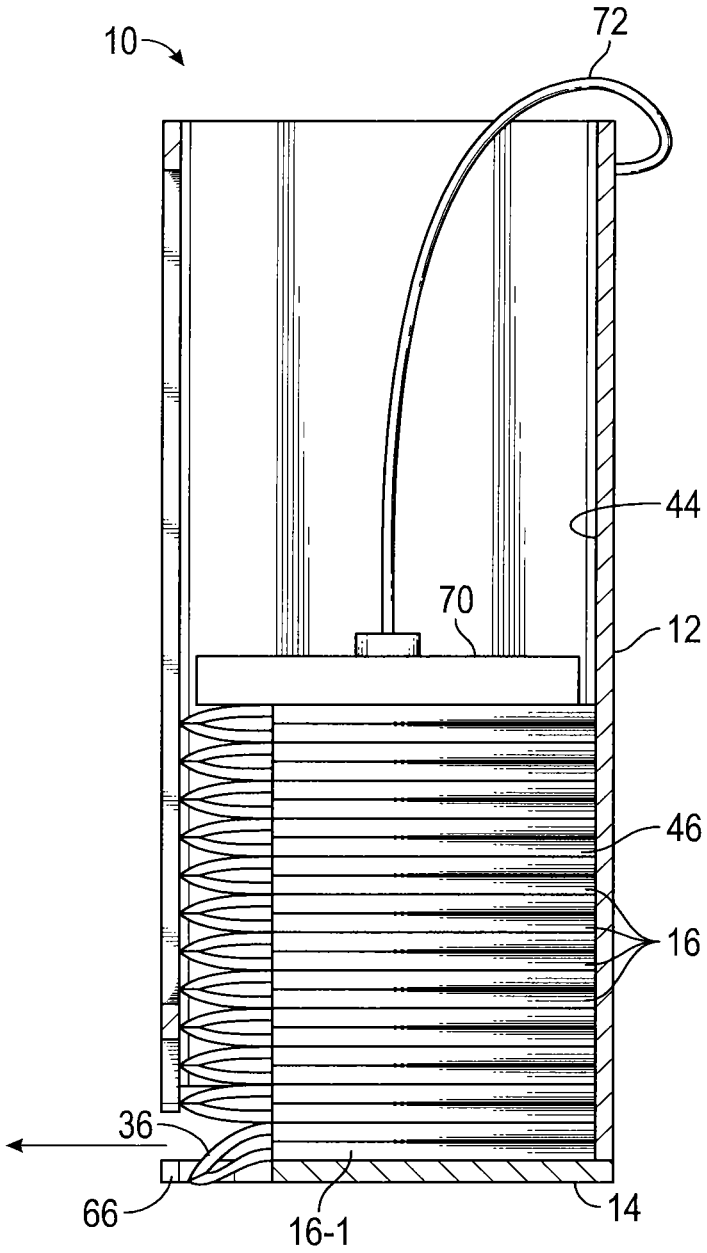
FIG. 6 is a cross-sectional view of the beverage container holder storage unit taken along line 6-6 of FIG. 1 in use according to some embodiments of the present disclosure.

Referring now to FIG. 6, the plurality of collapsible beverage container holders 16 may be stored in the beverage container holder storage unit 10 by a method including utilizing the beverage container holder storage unit 10 to receive the plurality of the collapsible beverage container holders 16 in a stacked configuration. The beverage container holder storage unit 10 may be implemented as described above. The plurality of the collapsible beverage container holders 16 may be inserted into the beverage container holder storage unit 10 to form the stack 46. The method may further be performed by inserting the force delivering element 70 on top of the stacked configuration of the plurality of collapsible beverage container holders 16.

A method of dispensing the collapsible beverage container holders 16 may be further performed by dispensing one or more of the plurality of collapsible beverage container holders 16 from the beverage container holder storage unit 10 through the discharge slot 50 in the beverage container holder storage unit 10. The discharge slot 50 may be implemented as described above. In some embodiments, the collapsible beverage container holders 16 may be dispensed from the beverage container holder storage unit 10 without a finger of the user breaking a vertical plane extending upwardly from the recess 60 of the support member 14. For example, as referenced above, the user may depress the bottom tab 36 of the bottommost beverage container holder 16-1 into the recess 60 and then grip the bottom tab 36 with one or more of the user's fingers and remove the bottommost collapsible beverage container holder 16-1 from the discharge slot 50. The user may remove the bottommost collapsible beverage container holder 16-1 by pulling the bottommost collapsible beverage container holder 16-1 through the discharge slot 50, in the direction of the arrow shown in FIG. 6, away from the beverage container holder storage unit 10 in a horizontal plane extending outwardly from the discharge slot 50. In some embodiments, the user may pull the bottommost collapsible beverage container holder 16-1 through the discharge slot 50 and away from the beverage container holder storage unit 10 at an angle from the horizontal plane extending outwardly from the discharge slot 50, for example, where the support member has an angled or sloped first surface 64 positioned at an angle to the horizontal plane extending outwardly from the discharge slot 50.

Although the preceding description has been described herein with reference to particular means, materials and embodiments, it is not intended to be limited to the particulars disclosed herein; rather, it extends to functionally equivalent structures, methods, and uses, such as are within the scope of the appended claims.

What is claimed is:

1. A storage unit in combination with a plurality of collapsible beverage container holders, the collapsible beverage container holders being movable between an expanded condition and a collapsed condition, each of the beverage container holders having a body with a sidewall and a bottom connected to the sidewall with the bottom forming a bottom tab extending from the sidewall when the beverage container holder is in the collapsed condition, the bottom tab being hingeable relative to the body along a straight line delineating the body and the bottom tab, the storage unit comprising:

a housing having a first end and a second end and defining an interior cavity in which the plurality of beverage container holders are vertically aligned with one another in the collapsed condition, the housing defining a discharge slot along a portion of the first end thereof through which a bottommost one of the plurality of beverage container holders is removable from the interior cavity along a horizontal plane;

a support member extending across the first end of the housing so as to support the plurality of beverage container holders in the interior cavity of the housing, the support member having a recess formed along at least one side thereof, the recess having a linear edge that is parallel with the straight line delineating the body and the bottom tab of the bottommost one of the beverage container holders, the recess configured to receive the bottom tab of the bottommost one of the plurality of beverage container holders, at least a portion of the support member and the recess being vertically aligned with the discharge slot of the housing such that the bottom tab of the bottommost one of the beverage container holders is positionable in the recess such that the bottom tab is hingeable relative to the linear edge of the recess to facilitate removal of the bottommost one of the beverage container holders from the interior cavity through the discharge slot along the horizontal plane via grasping and pulling the bottom tab; and a force delivering element positioned within the interior cavity of the housing to deliver force sufficient to collapse the bottommost one of the beverage container holders within the interior cavity, the force delivering element configured to deliver consistent force to the plurality of collapsible beverage container holders regardless of a vertical position of the force delivering element within the interior cavity of the housing.

2. The storage unit of claim 1, further comprising a lid sized and dimensioned to cover the second end of the housing.

3. The storage unit of claim 1, wherein the discharge slot has a generally rectangular shape.

4. The storage unit of claim 3, wherein the housing further defines a semicircular notch extending upwardly from the discharge slot configured to receive at least a portion of a finger of a user.

5. The storage unit of claim 1, further comprising a connector extending between the force delivering element and the housing to connect the force delivering element proximate to the second end of the housing, such that the force delivering element maintains a connection to the housing when removed from the interior cavity.

6. A method for storing a plurality of collapsible beverage container holders, comprising:

inserting a plurality of collapsible beverage container holders into a beverage container holder storage unit, the collapsible beverage container holders being movable between an expanded condition and a collapsed condition, each of the beverage container holders having a body with a sidewall and a bottom connected to the sidewall with the bottom forming a bottom tab extending from the sidewall when the beverage container holder is in the collapsed condition, the bottom tab being hingeable relative to the body along a straight line delineating the body and the bottom tab, the storage unit comprising:

a housing having a first end and a second end and defining an interior cavity in which the plurality of beverage container holders are vertically aligned with one another in the collapsed condition, the housing defining a discharge slot along a portion of the first end thereof through which a bottommost one of the plurality of beverage container holders is removable from the interior cavity along a horizontal plane; and a support member extending across the first end of the housing so as to support the plurality of beverage container holders in the interior cavity of the housing, the support member having a recess formed along at least one side thereof, the recess having a linear edge that is parallel with the straight line delineating the body and the bottom tab of the bottommost one of the beverage container holders, the recess configured to receive the bottom tab of the bottommost one of the plurality of beverage container holders, at least a portion of the support member and the recess being vertically aligned with the discharge slot of the housing such that the bottom tab of the bottommost one of the beverage container holders is positionable in the recess such that the bottom tab is hingeable relative to the linear edge of the recess to facilitate removal of the bottommost one of the beverage container holders from the interior cavity through the discharge slot along the horizontal plane via grasping and pulling the bottom tab; and inserting a force delivering element on top of the plurality of collapsible beverage container holders, the force delivering element configured to deliver consistent force to the plurality of collapsible beverage container holders regardless of a vertical position of the force delivering element within the interior cavity of the housing, the force sufficient to collapse the bottommost one of the beverage container holders.

* * * * *